US008365444B2

(12) United States Patent
Youngs

(10) Patent No.: US 8,365,444 B2
(45) Date of Patent: Feb. 5, 2013

(54) ARTICULATING FOOTWEAR SOLE

(75) Inventor: Bryan Kime Youngs, Portland, OR (US)

(73) Assignee: Keen, Inc., Portland, OR (US)

( * ) Notice: Subject to any disclaimer, the term of this patent is extended or adjusted under 35 U.S.C. 154(b) by 0 days.

(21) Appl. No.: 13/290,681

(22) Filed: Nov. 7, 2011

(65) Prior Publication Data

US 2012/0055047 A1 Mar. 8, 2012

(51) Int. Cl.
*A43B 13/12* (2006.01)
*A43B 13/14* (2006.01)

(52) U.S. Cl. ..... 36/102; 36/30 R; 36/73

(58) Field of Classification Search ..... 36/102, 36/30 R, 73, 25 R, 61, 27
See application file for complete search history.

(56) References Cited

U.S. PATENT DOCUMENTS

| | | | | |
|---|---|---|---|---|
| 5,337,494 | A * | 8/1994 | Ricker | 36/61 |
| 5,870,838 | A * | 2/1999 | Khayat | 36/61 |
| 6,167,639 | B1 * | 1/2001 | Ventura | 36/44 |
| 6,983,557 | B2 * | 1/2006 | Manz et al. | 36/103 |
| 7,752,775 | B2 * | 7/2010 | Lyden | 36/67 D |
| 2005/0039350 | A1 * | 2/2005 | Hung | 36/107 |
| 2007/0062068 | A1 * | 3/2007 | Li | 36/73 |

* cited by examiner

*Primary Examiner* — Ted Kavanaugh
(74) *Attorney, Agent, or Firm* — Alleman Hall McCoy Russell & Tuttle LLP

(57) ABSTRACT

An articulating footwear sole is provided. The articulating footwear sole includes a midsole having a recess a first plate having a first end interlocking with a second end of a second plate, the first and second plates positioned within the plate recess and held in place free of adhesive. In another embodiment, the sole includes a midsole having a recess, a first plate including a first end, and a second plate including a second end, the first end configured to moveably overlap with the second end, the first and second plates positioned in the recess. Still other examples are also provided.

19 Claims, 11 Drawing Sheets

ARTICULATING FOOTWEAR SOLE

BACKGROUND/SUMMARY

Footwear construction approaches commonly use solvent-based adhesives to bond various components together and to improve the performance and aesthetics of the product. For example, solvent-based adhesives may be used in the footbed, the outsole, the midsole, the insole, and further may be used to attach the aforementioned components to one another. Solvent-based adhesives may include polyurethane and polychloroprene adhesives, as well as various other organic solvents.

When used in the construction process, solvent-based adhesives can emit volatile organic compounds (VOCs), which can produce indoor and/or outdoor air pollution and thus degrade the quality of the environment. In addition to emissions generated during the application and/or curing processes, any excess adhesive in the manufacturing process may also be considered environmental waste, also potentially impacting the quality of the environment. In fact, various regulations exist with regard to use, handling, and disposal of solvent-based adhesives.

In one particular example of footwear construction, solvent-based adhesives are used in constructing "minimalist" or any type of shoes, where adhesives bond a protective plate into the sole to provide impact protection to the wearer's foot from rocks and other debris that may be on the surface of travel. "Minimalist" shoes in particular, as well as running and hiking shoes, attempt to increase the flexibility of the sole to increase the tactile responsiveness of the shoe.

However, the Inventor herein has recognized several drawbacks with using solvent-based adhesive to bond a protective plate to a midsole in shoes but in particular a "minimalist" type shoe. As discussed above, the solvent-based adhesive can negatively impact the quality of the environment during construction. Moreover, this type of bonding may decrease the flexibility of the shoe sole, thereby undermining the original design objective of increasing flexibility. The adhesive may also be costly and involve significant additional material handling requirements due to potential environmental impacts.

In one approach, at least some of the above issues are addressed by an articulating footwear sole including a midsole having a recess, with first and second plates positioned within the plate recess and held in place free of adhesive. The first plate has a first end interlocking with a second end of the second plate, so as to still provide protection from rocks and other debris that may be encountered on the ground. Additionally, the interlocking ends provide flexibility during use as the plates are constrained by the recess without the adhesives. In this way, the plates can move and flex with respect to one another and other components of the sole, while the interlocking ends maintain a protective layer. Further, the reduction in adhesives enables footwear incorporating the sole to reduce negative impacts on the quality of the environment.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE FIGURES

FIGS. 2-10 and 14-20 are drawn approximately to scale.

DETAILED DESCRIPTION

An articulating footwear sole is described herein. The articulating footwear sole may include two plates having interlocking ends configured to permit movement in the connection when the sole flexes. The interlocking plates may be held in the sole free of adhesives, thus enabling the plates to move and flex with respect to one another. Yet, the interlocking plates, which may overlap across the width of the sole, maintain a protective plate layer even with movement of the plates within the recess during flexion. In this way, the sole protects the wearer's foot from increased impact and puncture while maintaining flexibility, and while reducing environmental impacts from solvent-based adhesives.

Figure 1:
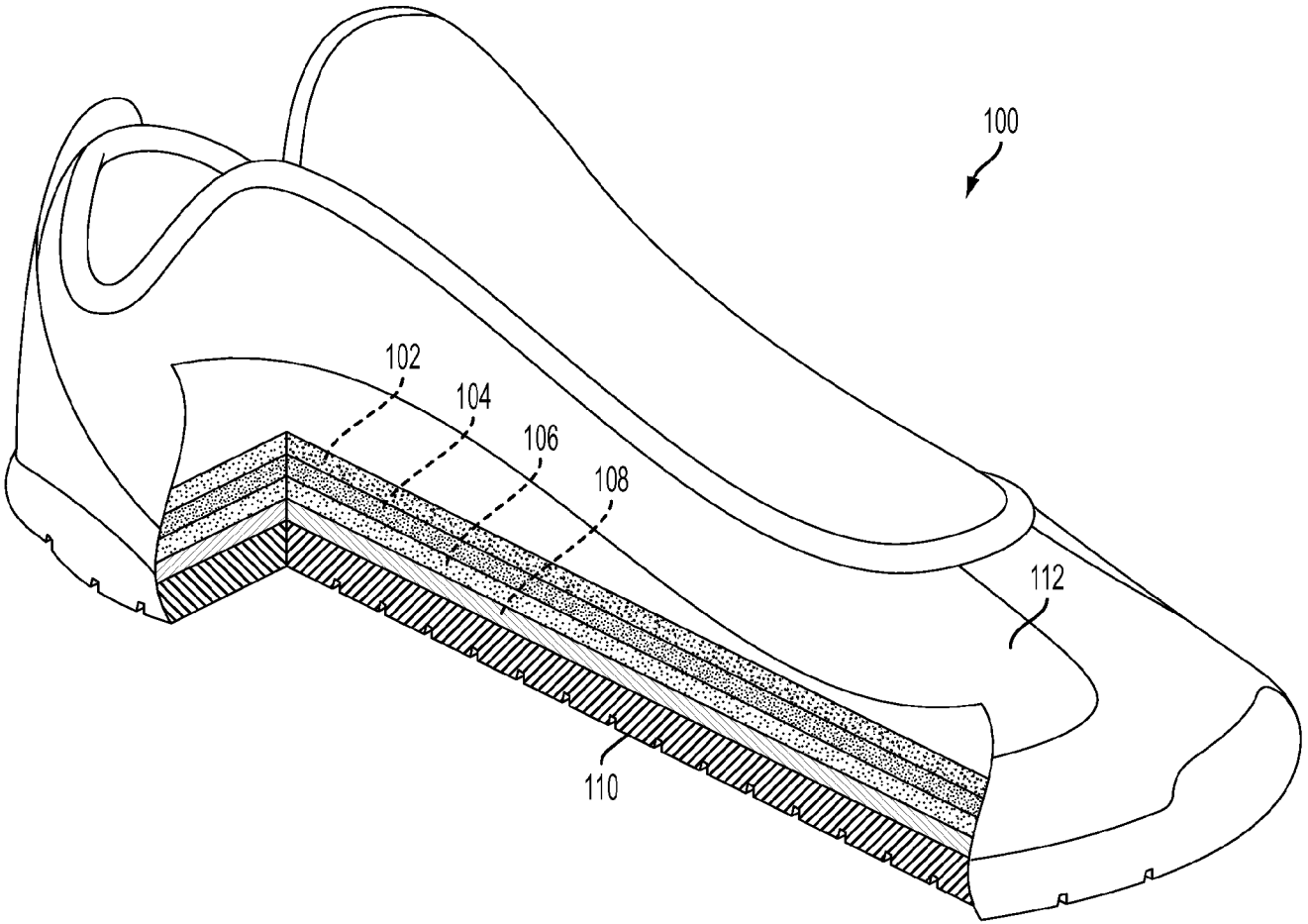
FIG. 1 PRIOR ART
FIG. 1 shows a prior art article of footwear.
Figure 3:
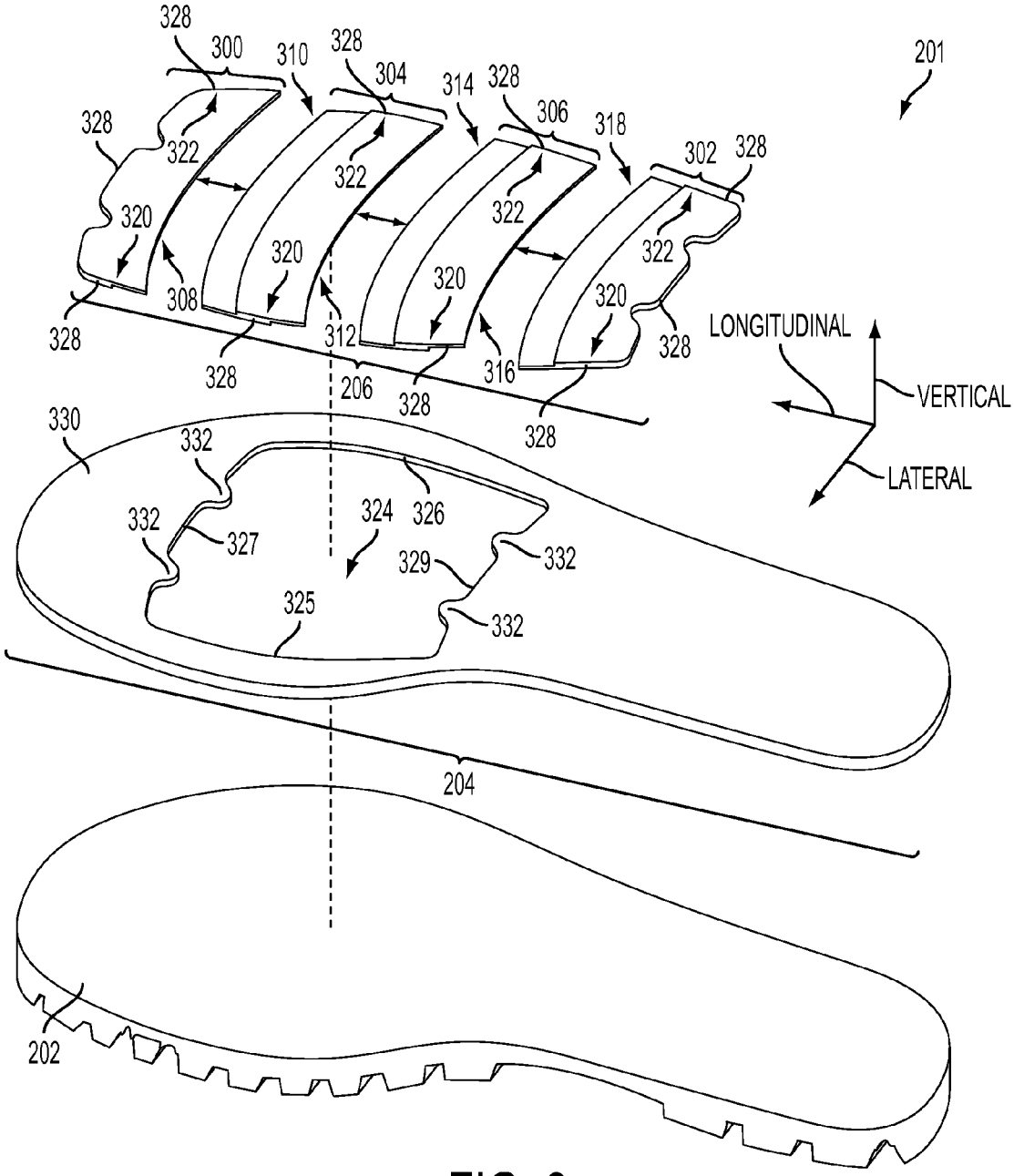
FIG. 3 shows an exploded view of an outsole and midsole having a plurality of integrated plates included in the article of footwear shown in FIG. 2.
Figure 4:
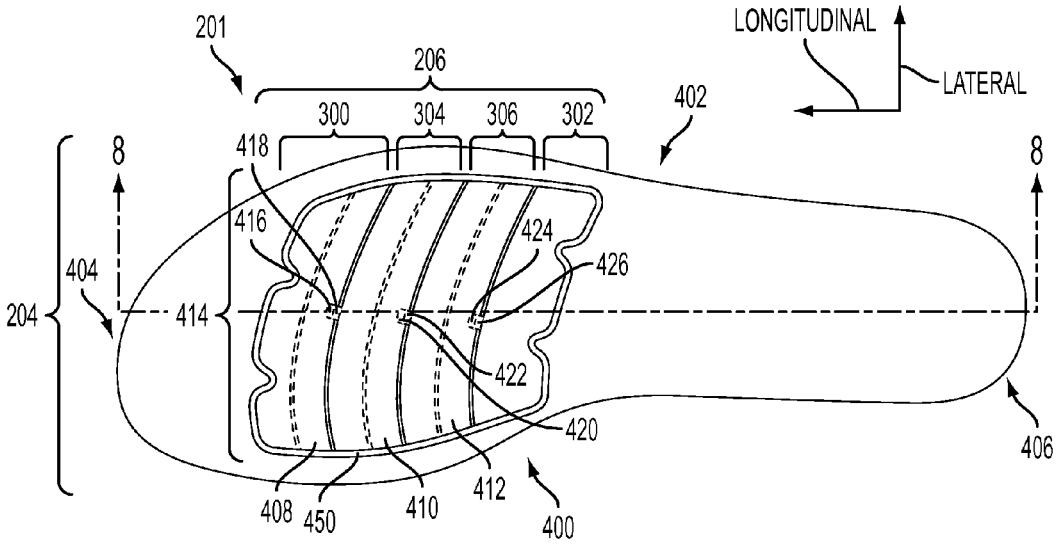
FIG. 4 shows an assembled top view of the midsole shown in FIG. 3
Figure 9:
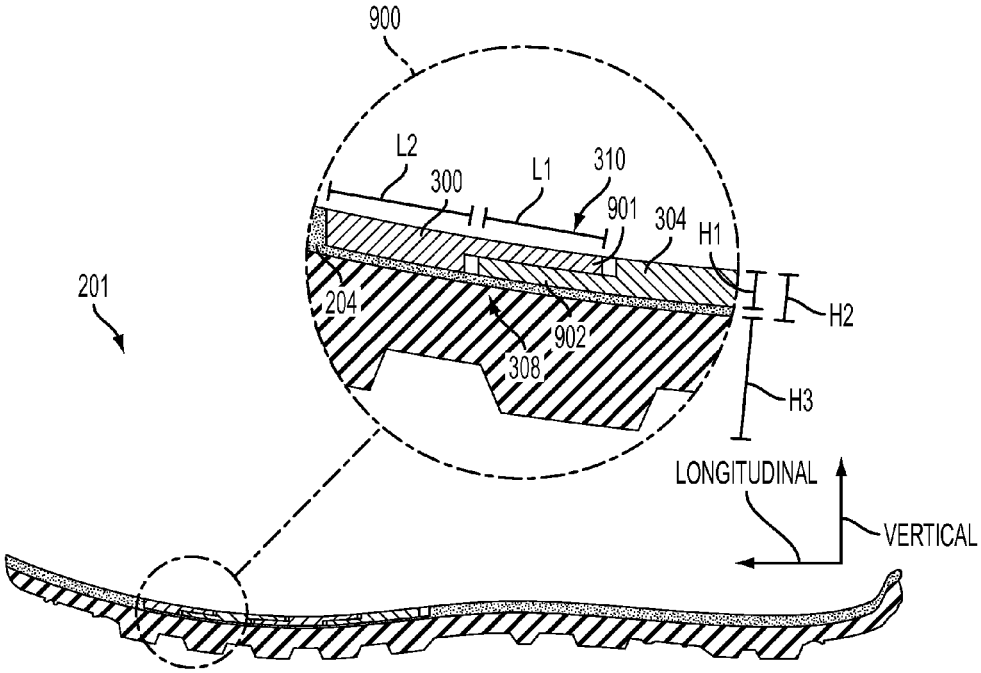
FIG. 9 shows a cross-sectional view of the midsole and outsole shown in FIG. 3 assembled.
Figure 10:
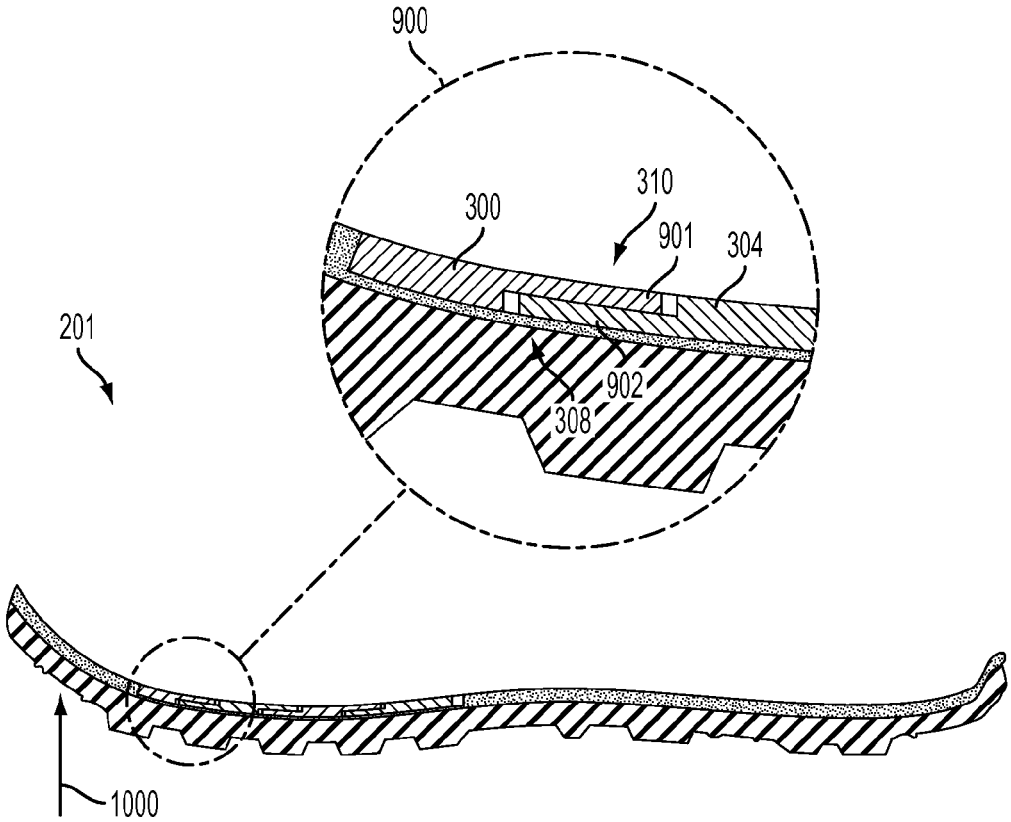
FIG. 10 shows the midsole and outsole in FIG. 9 in a flexed position.
Figure 11:
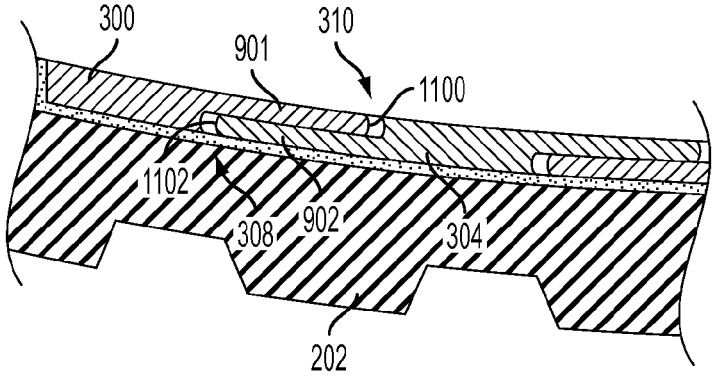
FIGS. 11-13 show other embodiments of the interlocking ends shown in FIG. 9.
Figure 12:
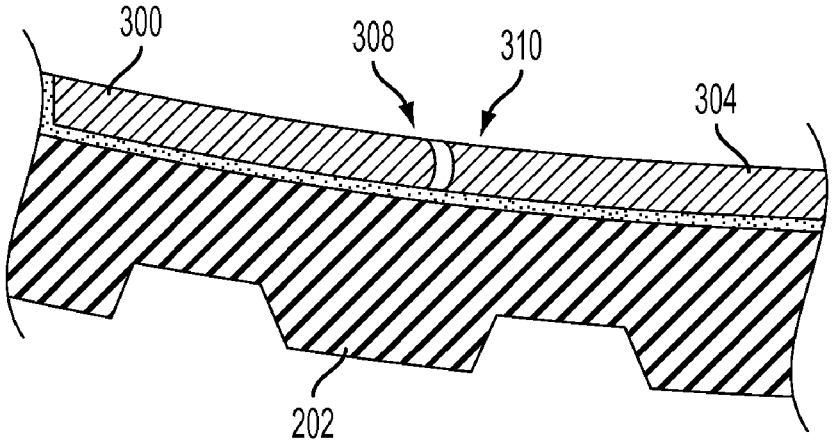
Figure 13:
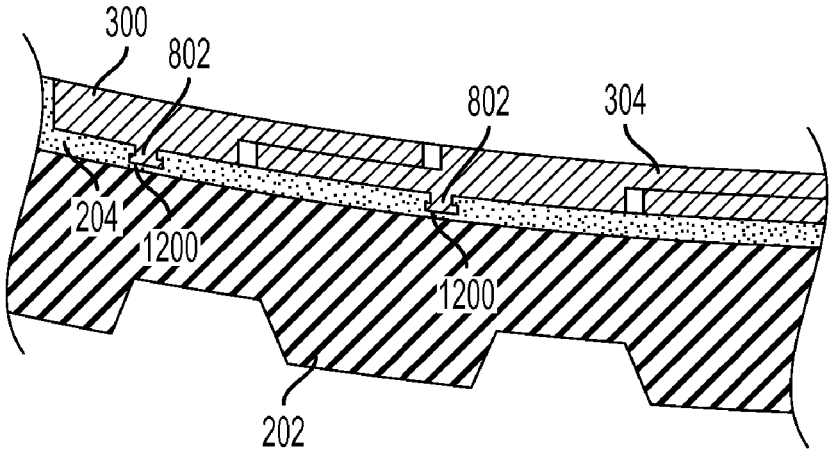

FIG. 1 shows a prior art article of footwear for comparison in which a typical rock plate is illustrated. This is contrasted with an embodiment of the invention illustrated in FIG. 2 in which a flexible plate is shown with interlocking plates. FIG. 3 shows an exploded view of the plates and the midsole having a recess in which the plates are held in place without adhesives on the surfaces of the plates. FIG. 4 shows an assembled top view of the midsole shown in FIG. 3. FIGS. 5-8 show other example embodiments of the plates and midsole that may be used, for example with different interlocking regions, modified geometries, etc. FIG. 9 shows a cross-sectional view of the midsole and outsole shown in FIG. 3 assembled. FIG. 10 shows the midsole and outsole of FIG. 9 in a flexed position. Finally, FIGS. 11-13 show other example embodiments of the interlocking ends shown in FIG. 9, illustrating other example overlapping that may be used, along with different interconnections that may be used.

FIG. 1 shows a prior art article of footwear 100. As shown, article of footwear 100 includes a footbed 102, an insole 104, a midsole 106, a rock plate 108, and an outsole 110. Each of the aforementioned footwear constituents are separately constructed and subsequently adhesively bonded via a solvent-based adhesive. For example, rock plate 108 is bonded via both its upper and lower surfaces to the insole and midsole, respectively. Moreover, the rock plate 108 forms a separate layer and is interposed between the midsole 106 and the outsole 110. The article of footwear 100 further include a vamp 112 coupled to the insole 104. The article of footwear 100 has several drawbacks including increased environmental impact, due to the amount of solvent-based adhesive used in construction as well as the inflexibility of the sole.

Figure 2:
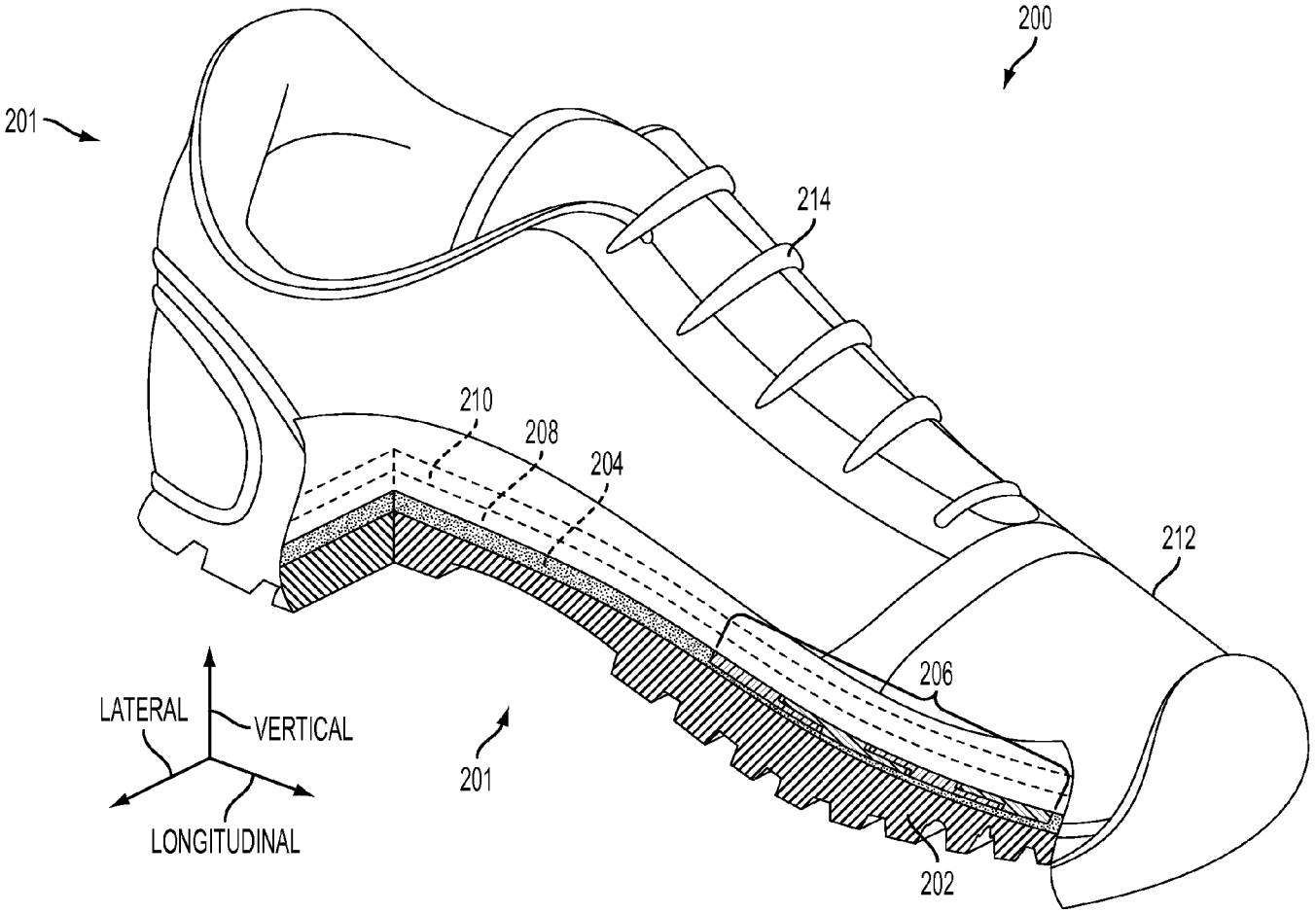
FIG. 2 shows an article of footwear according to an embodiment of the disclosure.

FIG. 2 shows an article of footwear 200 according to an embodiment of the disclosure. As shown, the article of footwear 200 includes an articulating footwear sole 201. The articulating footwear sole 201 may include one or more of the following elements: an outsole 202 and a midsole 204 having plates 206 integrated therein, an insole 208, and a footbed 210. One or more of the elements may be manufactured via injection molding or another suitable manufacturing technique. The outsole 202 is positioned below the midsole 204 in the embodiment depicted in FIG. 2. It will be appreciated that the plates 206 flex with respect to one another to enable articulation of the sole 201, while each individual plate may be substantially rigid in relation to the midsole 204 and the outsole 202, for example. Additional details of the plates 206 are discussed in greater detail herein with regard to FIGS. 3-20. The midsole 204 is interposed between the outsole 202 and the insole 208. It will be appreciated that in other embodiments, the insole 208 and/or footbed 210 may not be included in the article of footwear 200 to decrease the weight, as well as increase the flexibility, of the articulating footwear sole 201. Moreover, the vertical height of the footbed 210, insole 208, and/or outsole 202 may be altered to increase flexibility of the articulating footwear sole 201. The relative thickness of the aforementioned elements is discussed in greater detail herein with regard to FIG. 9.

In one embodiment, the construction illustrated in FIG. 2 enables increased tactile responsiveness of the article of footwear 200. Moreover, barefoot travel may be simulated while providing impact and puncture protection via the plates 206.

The article of footwear 200 further includes a vamp 212. The vamp 212 is configured to at least partially surround a wearer's foot. The vamp 212 includes laces 214 to secure the article of footwear 200. Additionally or alternatively, the vamp 212 may include elastic bands, hook and loop fasteners, clips, etc., for securing the article of footwear 200. The vamp 212 may be coupled (e.g., sewn) to the insole 208 in some embodiments. However, in other embodiments the vamp 212 may be coupled to the midsole 204. In some embodiments, the article of footwear 200 may include a viewing window in the articulating footwear sole 201 configured to enable viewing of the plates 206. The viewing window may be in the side of the article of footwear. The viewing window may comprise a partially transparent material, such as a partially transparent polymeric material. Although a right footed article of footwear is depicted, it will be appreciated that the disclosure contemplates a left footed article of footwear, as well as various sizes and other modifications.

While the example shown in FIG. 2 includes an outsole, in another embodiment outsole 202 may be omitted and the plates 206 may form at least a portion of an outermost layer of the sole. Further still, the plates 206 may also be positioned in an outsole.

FIG. 3 shows an exploded view of the articulating footwear sole 201 including the midsole 204 and the plates 206 integrated therein. As shown, the outsole 202 may also be included in the sole 201. Although the midsole 204 and the outsole 202 are shown as separate layers, the midsole 204 and the outsole 202 may form one continuous piece of material in other embodiments. Therefore, the midsole 204 and the outsole 202 may be jointly molded.

In the depicted embodiment four plates are shown. However, in other embodiments the number of plates may be altered. For example, the midsole 204 may only have a first and a second plate integrated therein or additional plates may be integrated into the midsole 204. Additionally, the plates 206 have varying sizes and geometries. However, in other embodiments the plates 206 may have similar geometries and/or sizes.

The plates 206 may be held in the articulating footwear sole 201 free of adhesive. In this way, the environmental impact to the sole manufacturing process may be diminished when compared to other soles using adhesive to bond all of the sole layers to one another. The articulating footwear sole 201 include a front plate 300 positioned adjacent to the front of the article of footwear 200. In some examples, the front plate 300 is configured to sit under the toes of the wearer, and thus may be referred to as a toe plate. The article of footwear 200 further includes a rear plate 302 and two intermediary plates 304 and 306. Each of the plates (300, 302, 304, and 306) includes at least one end configured to interlock, for example by overlapping (e.g., articulably overlapping), with an end in a different plate. For example, the front plate 300 includes an end 308 configured to interlock with a first end 310 of the intermediary plate 304. Likewise, the first intermediary plate 304 includes a second end 312 configured to interlock with a first end 314 of the second intermediary plate 306. Likewise, the second intermediary plate 306 includes a second end 316 configured to interlock with a first end 318 of the rear plate 302. Thus, the intermediary plates (304 and 306) include two interlocking ends and the front and rear plates (300 and 302) include one interlocking end. Each of the plates 206 further includes medial ends 320 and lateral ends 322. The medial and lateral ends (320 and 322) are not interlocked with other ends. However, in other embodiments, one or more of the medial ends 320 and/or lateral ends 322 may be configured to interlock with an end of another plate, discussed in greater detail herein with regard to FIG. 6.

The plates 206 may be constructed of various materials. For example, the plates 206 may comprise polymeric material, such as thermoplastic polyurethane (TPU), nylon, polyurethane (PU), Ethylene vinyl acetate (EVA), bamboo, or other suitable materials having similar characteristics.

The midsole may be constructed of a relatively flexible material (as compared to the plates, such as Ethylene vinyl acetate (EVA), polyurethane (PU), rubber, thermoplastic polyurethane (TPU), thermoplastic rubber (TPR), thermal plastic rubber (TR), or other suitable materials having similar characteristics.

The midsole 204 includes a recess 324 having a medial side 325, a lateral side 326, a toe side 327, and a heel side 329. The recess 324 is positioned in an upper side of the midsole 204. Moreover, the recess 324 is positioned in a forefoot region of the midsole 204. However, in other embodiments the recess 324 may be positioned in a lower side of the midsole 204 and/or in another region of the midsole 204, such as a heel region. When assembled, the plates 206 may substantially span the recess 324 from the medial side 325 to the later side 326 and/or from the toe side 327 to the heel side 329. In some embodiments, the recess 324 may be contoured such that a gap forms between the sides (325, 326, 327, and 329) of the recess and the outer edges 328 of the plates 206. In this way, the midsole 204 may be designed to accommodate articulation of the plates 206. However in other embodiments, the sides (325, 326, 327, and/or 329) of the recess 314 and the outer edges 328 of the plates 206 may be in face sharing contact.

Furthermore, when assembled, the plates 206 do not vertically extend above a top surface 330 of the midsole 204 in the depicted embodiment. In this way, the plates 206 can be integrated into the midsole 204 without increasing the profile of the midsole 204. However, in other embodiments the plates 206 may extend vertically above the top surface 330. The lateral, longitudinal, and vertical coordinate axes are provided for conceptual understanding. However, it will be appreciated the articulating footwear sole 201 may be positioned in a variety of orientations.

As illustrated in FIG. 3, the plurality of plates 206 interlock with one another via overlapping regions where extensions (e.g., extended lips) are in face-sharing contact with respective extensions of adjacent plates. The plates 206 are held in the midsole recess without adhesives affixed to upper or lower surfaces of the plates so that the plates can provide flexibility and so that the plates can slide with respect to the midsole and the insole and thus further increase flexibility of the article of footwear 200. At the same time, even when flexed, the plates 206 provide substantially continuous protection from rocks or other debris on the ground that may impact through the outsole 202 and midsole 204. Further, the reduction in adhesives reduces environmental impacts of the article of footwear. Further, in the example embodiment of a minimalist trail-running shoe, barefoot walking/running is more closely simulated since the article of footwear still maintains a low profile and light-weight construction.

As shown, the plates 206 have a uniform thickness with regard to the vertical axis. The thickness may be selected to provide a desired amount of flexibility while still offering impact and puncture protection in the forefoot region. The midsole 204 further includes protrusions 332. The protrusions 332 extend into the front plate 300 and the rear plate 302. The protrusions 332 can help reduce the movement between the midsole 204 and the front plate 300 and the rear plate 302, in some embodiments.

FIG. 4 shows a top view of the articulating footwear sole 201 including an assembled midsole 204 and plates 206. As shown, the plates 206 sit on an upper surface of the recess 324, shown in FIG. 3. It will be appreciated that the plates 206 may be held in place without adhesives bonded to either the upper or lower surfaces of any of the plates, in one example embodiment. It will be appreciated that the environmental impact and the production cost of the article of footwear 200 is decreased when less adhesive is used.

As shown, the midsole 204 includes a medial side 400 and a lateral side 402. The midsole 204 further includes a toe side 404 and a heel side 406. The interlocking ends (308, 310, 312, 314, 316, and 318 shown in FIG. 3) of the plates 206 extend in a direction from the medial side 400 to the lateral side 402. However, other positions may be used, in other embodiments. Furthermore, the interlocking ends (308, 310, 312, 314, 316, and 318 shown in FIG. 3) of the plates 206 extend across the midsole 204 in an arc. Therefore, the interlocking ends (308, 310, 312, 314, 316, and 318 shown in FIG. 3) are curved across the width of the sole 201. The curvature enables the plates 206 to articulate to the contours of the wearer's foot. In this way, a barefoot running/walking sensation may be better simulated. The curvature also enables the plates 206 to provide the wearer with a more natural foot strike as well as a biomechanically natural gait. However, in other embodiments the interlocking ends may not be curved.

As shown the end 308, shown in FIG. 3, partially overlaps with the first end 310, shown in FIG. 3, in an overlapping region 408. Likewise, the ends 312 and 314, shown in FIG. 3, partially overlap in overlapping region 410 and ends 316 and 318, shown in FIG. 3, overlap in overlapping region 412. It will be appreciated that the plates 206 may form a substantially continuous protection zone 414 that flexes about each overlapping region (408, 410, and 412). Furthermore, the overlapping regions (408, 410, and 412) extend across the full width of the plates 206. The plate width refers to the lateral dimension of the plates 206. However, in other embodiments, the overlapping regions (408, 410, and 412) may extend across the length of the plates 206 or may partially extend across the width of the plates 206. The plate length refers to the longitudinal dimension of the plates 206. It will be appreciated that interlocking ends (308, 310, 312, 314, 316, and 318 shown in FIG. 3) of the plates 206 are not rigidly coupled in the depicted embodiment. For example, the interlocking ends (308, 310, 312, 314, 316, and 318 shown in FIG. 3) may be moveably un-affixed to one another, yet overlapping. In this way, the plates 206 are allowed greater articulation when compared to plates having ends that securely attach to one another, or that are bonded to other layers on their top and/or bottom surfaces.

In some embodiments, an attachment apparatus 416 may be coupled to the front plate 300 and an attachment apparatus 418 may be coupled to the first intermediary plate 304. However, in other embodiments the attachment apparatus 416 may be integrated into the front plate 300 and the attachment apparatus 418 may be integrated into the first intermediary plate 304. The attachment apparatuses (416 and 418) may be configured to securely attach to one another. In some examples, a tongue and groove type connection may be used. In other examples, the plates 206 may be injected directly onto a textile which may be stitched to the midsole 204. Another attachment apparatus 420 may be coupled to the first intermediary plate 304 configured to securely attach to an attachment apparatus 422 coupled to the second intermediary plate 306. Yet another attachment apparatus 424 coupled to the second intermediary plate 306 is securely attached to an attachment apparatus 426 in the rear plate 302. When the attachment apparatuses are used to attach the plates 206 to each other, the relative longitudinal and lateral position of the plates 206 is substantially fixed with respect to one another. Moreover, the attachment apparatuses (416, 418, 420, 422, 424, and 426) fix an articulation point between adjacent plates. It will be appreciated that when the plates 206 include the attachment apparatuses (416, 418, 420, 422, 424, and 426), the interlocking ends of the plates 206 are movable when flexion is applied to the midsole 204. Therefore, the plates 206 remain vertically articulable when the attachment apparatuses are used.

The size and configuration of the attachment apparatuses (416, 418, 420, 422, 424, and 426) may be selected to decrease the impact on the flexibility of the interlocking ends of the plates 206. Further in some embodiments, two attachment apparatuses coupled to the corners of four plates may be used to attach the four plates. In this way, the number of attachment apparatuses used to attach the plates to one another is decreased.

As shown, the plates 206 are positioned in a forefoot region under the forefoot of the wearer, extending from a ball of the wearer's foot to an arch of the wearer's foot. In this way, the plates 206 may provide impact and puncture protection to the wearer's forefoot. However in other embodiments, the plates 206 may be positioned in another location.

In some embodiments, an adhesive (e.g., natural adhesive) may be applied in a bonding region 450 outside and around the edges 328 of the plates (300, 302, 304, and 306). Moreover, the adhesive may bond the insole to the midsole around an outer perimeter of the plates (300, 302, 304, and 306) and/or around a perimeter of the recess.

Figure 5:
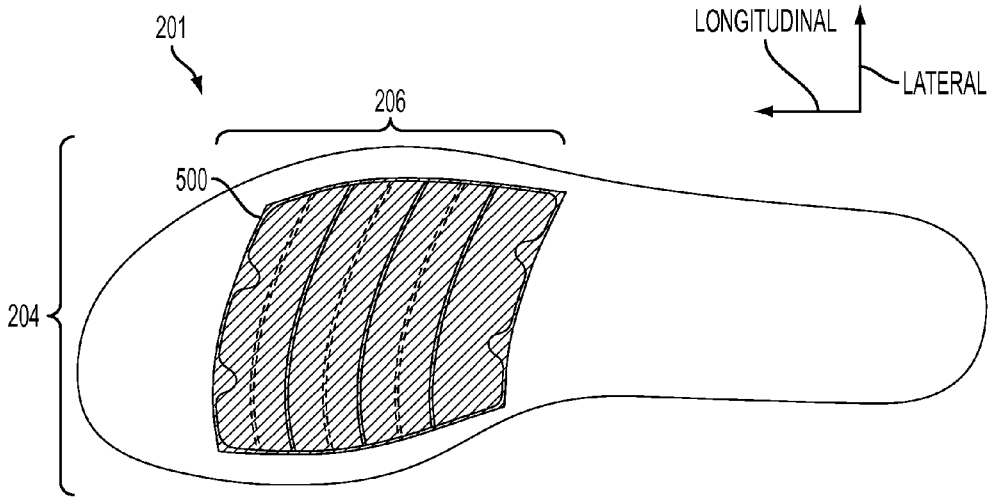
FIGS. 5-8 show other embodiments of the plates and midsole included in the article of footwear show in FIG. 2.

In the embodiment depicted in FIG. 5 a retaining material 500, such as a fabric, spans the plates 206 and recess 324, shown in FIG. 3. Therefore, the plates 206 are interposed between the midsole 204 and the retaining material 500. The retaining material 500 is attached (e.g., sewn) to the midsole 204. In this way, the plates 206 may be held in the recess 324 free of adhesive. In some examples, the retaining material 500 may be at least partially see-through to enable viewing of the plates 206. Further in some embodiments, portions of the insole 208 and/or footbed 210 may be at least partially see-through to enable viewing of the plates 206.

In some embodiments the insole 208 may have a partially or totally clear region vertically above at least a portion of the plates 206, for example above an interface between different plates, such as above a first end of a first plate interlocking with a second end of a second plate. Further, a plurality of plate interlocking joints may be exposed via the clear regions of the insole.

Figure 6:
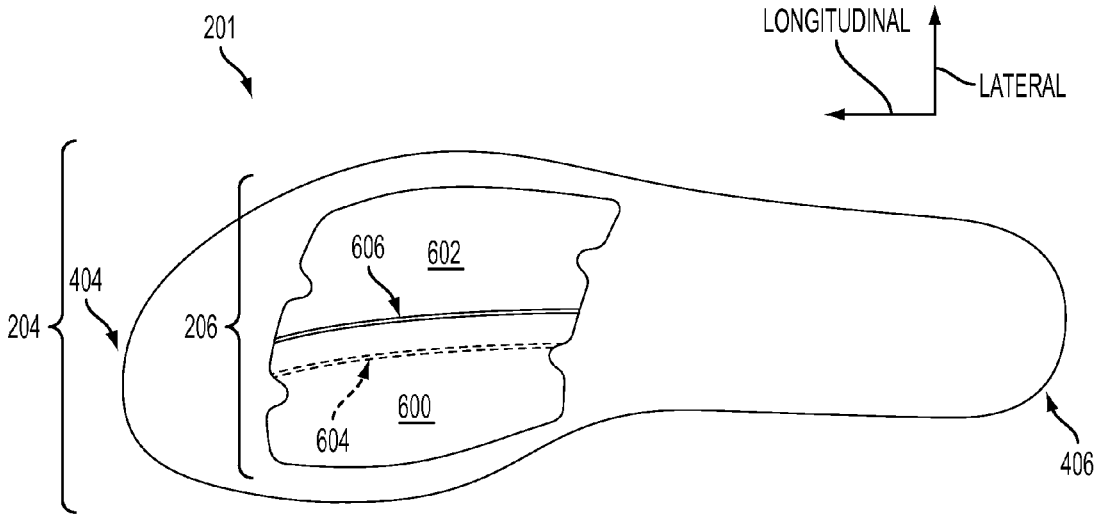

FIG. 6 shows another embodiment of the midsole 204 and the plates 206. A medial plate 600 and a lateral plate 602. The medial plate 600 includes an end 604 interlocked with an end 606 included in the lateral plate 602. As shown, the interlocking ends (604 and 606) extend in a longitudinal direction. Specifically, the interlocking ends (604 and 606) extend in a direction from the toe side 404 of the midsole 204 to the heel side 406 of the midsole. In this way, the plates 206 may have flexibility in a lateral direction (i.e., side to side flexibility). It will be appreciated that the embodiment of the articulating footwear sole 201 shown in FIGS. 3 and 4 may also include interlocking ends extending in a longitudinal direction. In this way, the flexibility of the sole is increased.

Figure 7:
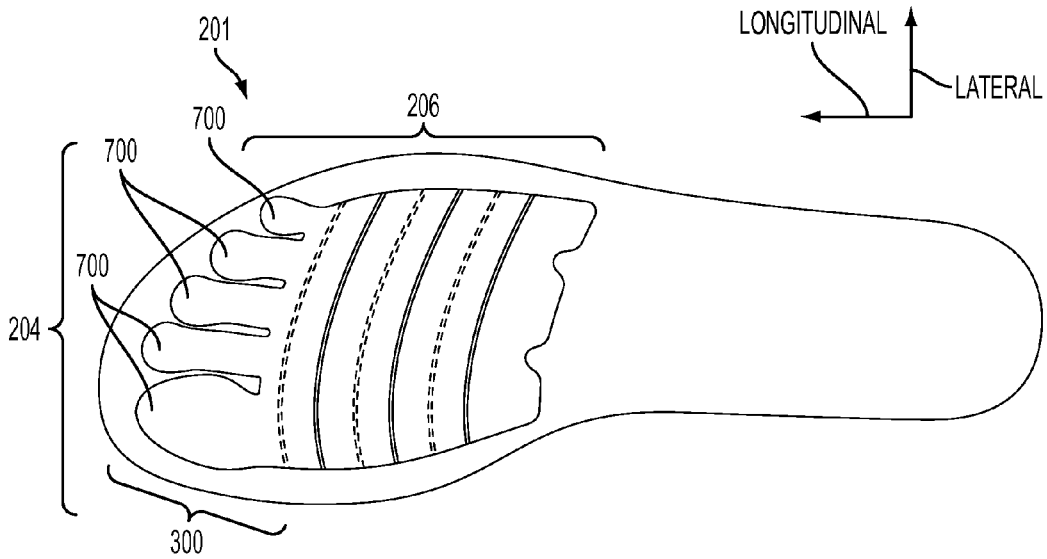

FIG. 7 shows another embodiment of the midsole 204 and the plates 206. In the depicted embodiment, the front plate 300 includes sections 700 which extend toward the front of the midsole 204. It will be appreciated, that sections 700 may be positioned under the toes of the wearer. In this way, impact and puncture protection may be provided to additional areas of the foot. In some examples, each of the sections may be separate plates and include an edge interlocking with an edge of the front plate 300.

Figure 8:
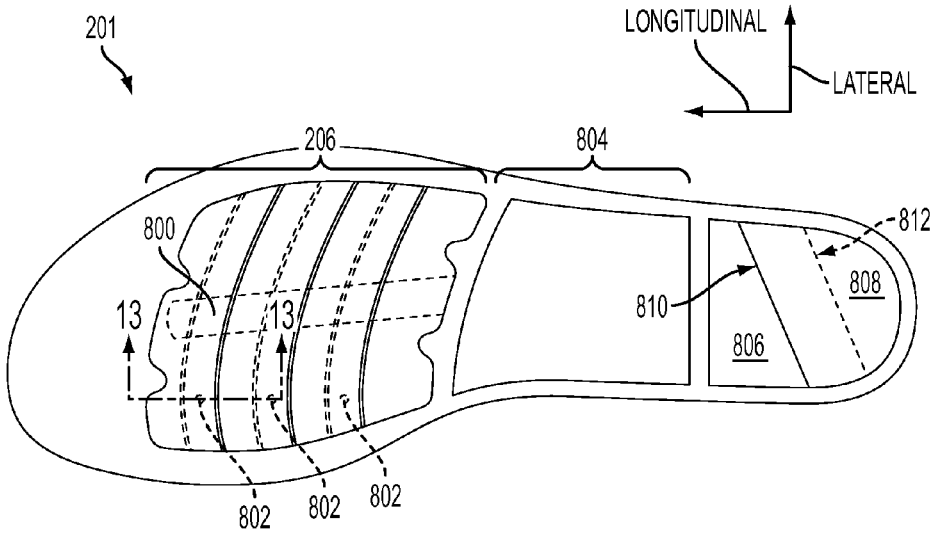

FIG. 8 shows another embodiment of the midsole 204 and the plates 206. As shown, strip of tape 800 may be attached to the plates 206. In this way, the relative longitudinal and lateral position of the plates with respect to one another is substantially fixed by the strip of tape 800. The adhesive used in the tape may be a natural adhesive. However, in other embodiments the strip of tape omitted. Each plate may further include a post 802. The posts 802 may extend vertically into the midsole 204, discussed in greater detail herein with regard to FIG. 13. An arch plate 804, a first heel plate 806, and a second heel plate 808 may also be integrated into the midsole 204 to provide additional protection. The arch plate 804 is spaced away from the first and second heel plates (806 and 808) as well as plates 206.

The arch plate 804 and the heel plates (806 and 808) may each sit in a recess in the midsole 204. The first heel plate 806 may include an end 810 configured to interlock with an end 812 of the second heel plate 808. In this way, flexibility and articulation may be provided to the heel plates. The heel plates (806 and 808) are positioned in a heel region extending from the heel side of the foot to an arch of the foot. It will be appreciated that two or more arch plates having interlocking ends may be used in other embodiments to enable greater flexion of the arch region.

FIG. 9 shows a cut-away view of the articulating footwear sole 201 including the assembled midsole 204 and plates 206 shown in FIG. 4 as well as the outsole 202 shown in FIGS. 2 and 3. An enlarged view of the front plate 300 and the intermediary plate 304 is shown at 900 illustrating the interlocking connection between the end 308 and the end 310. The overlapping region 408 is illustrated. The end 308 includes an extension 901 configured to sit on extension 902 included in the first intermediary plate 304. In this way, the ends (308 and 310) are mated with one another. Extension 902 is positioned vertically below and is in contact with extension 902. In the embodiment shown in FIG. 9, the vertical heights of the extensions (901 and 902) are substantially identical. However, in other embodiments the size and/or geometry of the extensions may be altered.

The ratio between the length L1 of the extension 901 is shown in FIG. 9 and the length L2 of a portion of the plates that do not include an extension may be substantially equal or may have varied ratio combinations. Moreover, in plates having two extensions, such as plates 304 and 306 shown in FIG. 3, the length of the plate extensions may be substantially equivalent. It will be appreciated that when these geometric proportionalities are used a desired amount of plate articulation and impact protection is provided in the articulating footwear sole 201. However, in other embodiments, the length of the extensions and the length of the portions of the plates that do not include the extensions may be altered.

In the embodiment depicted in FIG. 9, the ratio between the thickness H1 of the plates 206 and the thickness H2 of the midsole 204 may be less than 1 or another suitable ratio. Likewise, the ratio between the thickness H3 of the outsole 202 and the thickness H2 of the midsole may be any suitable ratio. Moreover, the ratio between the thickness of the insole 208 or the footbed 210 and the thickness H2 of the midsole 204 may be any suitable ratio. It will be appreciated that when the aforementioned thickness ratios are utilized a desired balance between flexibility and impact protection in the articulating footwear sole 201 may be achieved. However, in other embodiments others thickness ratios may be utilized.

FIG. 10 shows the articulating footwear sole 201 shown in FIG. 9 having a flexion force 1000 applied thereto. As shown, the interlocking ends (308 and 310) move with regard to one another to accommodate the flexion.

FIG. 11 shows another embodiment of the interlocking connection between the end 308 of the front plate 300 and the end 310 of the first intermediary plate 304. The midsole 204 and outsole 202 is also shown in FIG. 11. A portion 1100 of the extension 901 is curved. Likewise, a portion 1102 of the extension 902 is curved. Thus, the extensions (901 and 902) are curved in a cross-section perpendicular to a line tangent to the first and second ends. It will be appreciated that the curved portion enable the front plate 300 and the first intermediary plate 304 to move with less deformation and friction when flexion is applied to the articulating footwear sole 201.

FIG. 12 shows another embodiment of the interlocking connection between the end 308 of the front plate 300 and the end 310 of the first intermediary plate 304. The midsole 204 and outsole 202 is also shown in FIG. 12. As shown, the entire end 308 is curved. Likewise, the entire end 310 is correspondingly curved to mate with the end 308.

FIG. 13 shows a cross-sectional view of the embodiment of the articulating footwear sole 201 shown in FIG. 8 including the midsole 204, outsole 202, and plates (300 and 304). Posts 802 extend into the midsole 204. In this way, the position of the plates (300 and 304) is fixed relative to the midsole 204. The posts 802 include a portion 1200 having a larger diameter than the remainder of the post 802. In this way, the posts 802 are anchored into the midsole 204.

Figure 14:
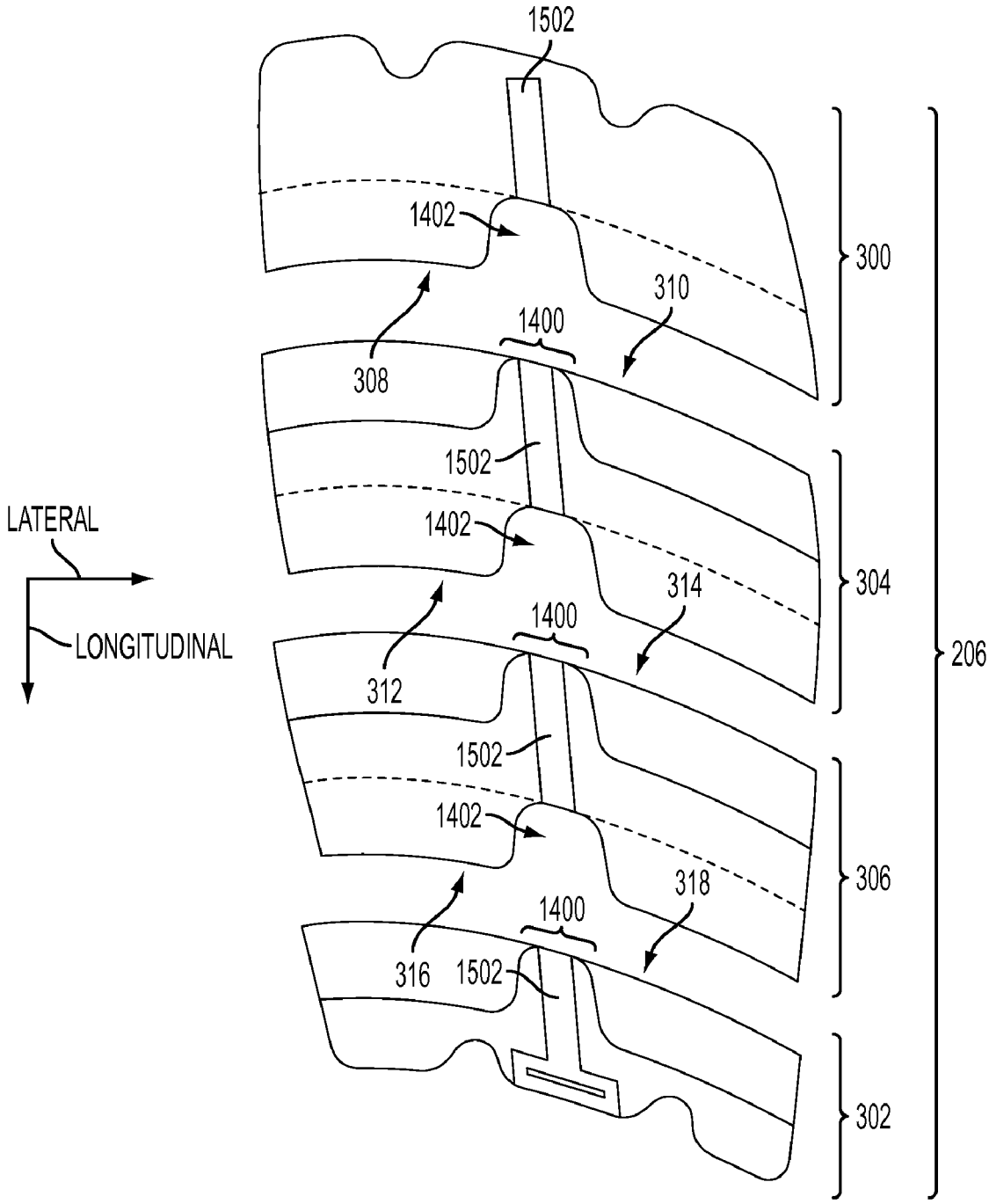
FIG. 14 shows an exploded view of another embodiment of the plates included in the article of footwear shown in FIG. 2.

FIG. 14 shows another embodiment of the plates 206 included in the articulating footwear sole 201 shown in FIG. 2. The plates 206 shown in FIG. 14 include some similar features. Therefore similar components are labeled accordingly. As shown, a portion of the plates 206 includes raised connection extensions 1400 and a portion of the plates 206 includes connection recesses 1402. Each raised connection extension 1400 is sized to mate with an adjacent connection recess 1402. For example, the connection extension included in the front plate 300 is sized to mate with the connection recess included in the intermediary plate 304. Likewise, the connection extension included in the rear plate 302 is sized to mate with the connection recess included in the intermediary plate 306. This matted connection can aid in the interlocking of the plates 206 with respect to one another during use. In this way, the plates 206 may remain in a desired location relative to one another during use while at the same time providing a desired amount of articulation and flexibility.

Additionally, the raised connection enables the sufficient thickness to be maintained along a longitudinal central region of the plates in order to retain the central rib 1502. The central rib 1502 (which is shown sectioned in FIG. 14 for ease of illustration) is a single, continuous rib having a uniform thickness and width along the length from one plate to the next plate, for example along its entire length up to the T-section at the rear end. Central rib 1502 is press-fit into a corresponding recess (see, e.g., FIGS. 19-20) in order to provide a central connection between multiple plates, yet still allow flexibility and articulation of the plates. In one example, the central rib 1502 may be formed of a different material than the plates, for example it may be formed with a material having a lower or higher modulus of elasticity relative to the material of the plates. For example, the central rib 1502 may comprise TPU, rubber, or another material.

In one embodiment, one or more of the plates 206 may be co-molded around the central rib 1502.

In the example of FIG. 14, it should be appreciated that the central rib 1502 is slightly angled with respect to the longitudinal axis. Further each raised connection extension 1400 (and corresponding connection recess 1402) follow the path of the central member rather than exactly aligning with the longitudinal member. Such positioning follows the natural shape of a wearer's foot, so that the articulation of the plates better matches the motion and articulation of the foot during use.

Figure 15:
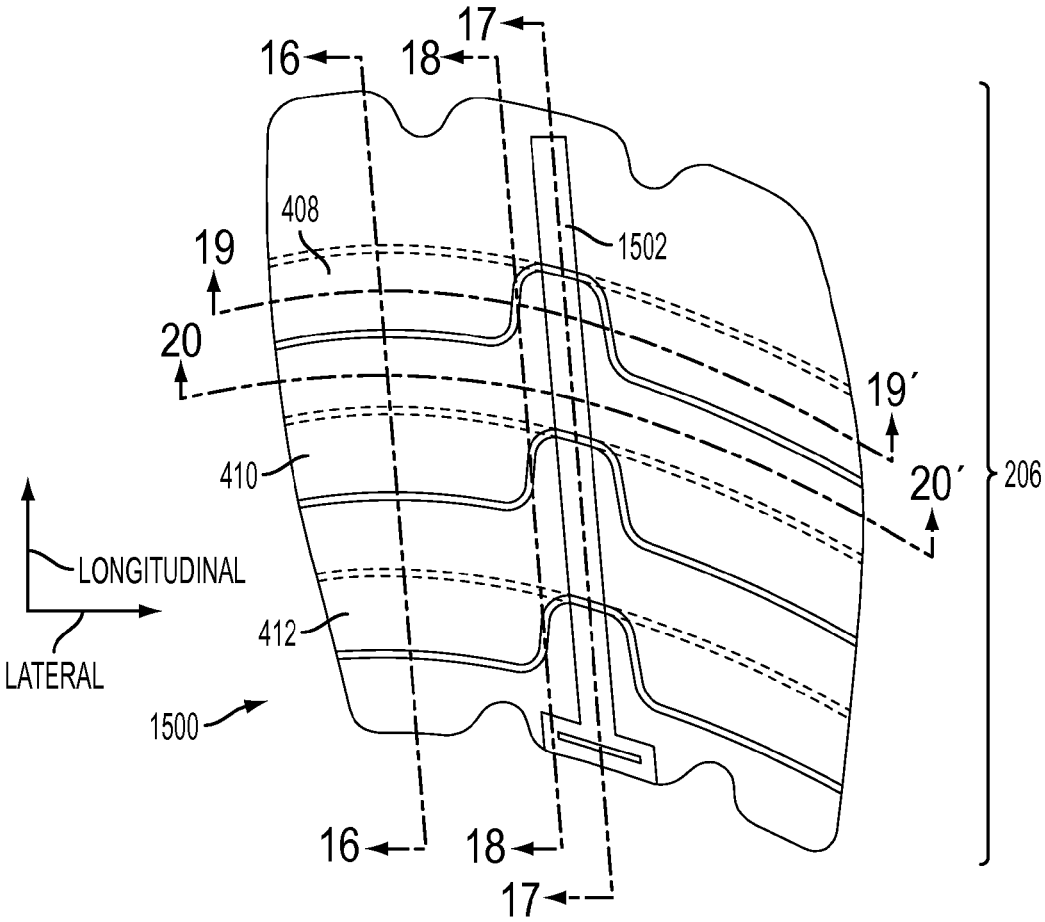
FIG. 15 shows an assembled view of the plates shown in FIG. 14.

FIG. 15 shows an assembled view of the plates 206, shown in FIG. 14. As illustrated, the plates 206 overlap to form a protection zone 1500. As explained above, the central rib 1502 extends in a longitudinal direction through each of the plates 206, although in other examples the rib may extend through less than all of the plates. The lateral movement of the plates 206 with regard to one another is reduced via the inter-coupling of the central rib. In such an embodiment, the overlapping regions (408, 410, and 412) between the ends (308, 310, 312, 314, and 316) of the plates 206 do not extend laterally across each respective plate.

Figure 16:
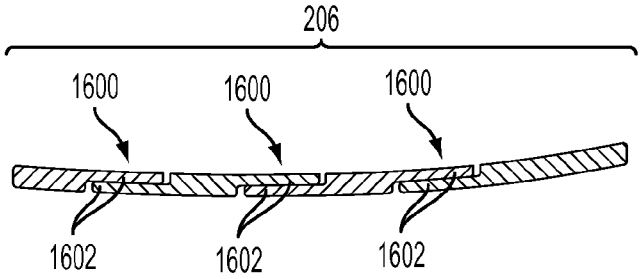
FIGS. 16-20 show cross-sectional views of the assembled plates shown in FIG. 15.

FIG. 16 shows a cross-sectional view of the assembled plates 206 shown in FIG. 15. As shown, the plates 206 include overlapping regions 1600 between the extensions 1602. In this way, a protection zone may be formed while providing articulation of the sole.

Figure 17:
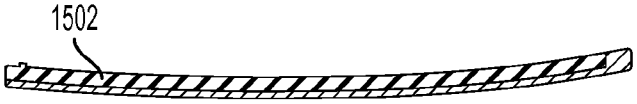

FIG. 17 shows another sectional view of the assembled plates 206 shown in FIG. 15. As illustrated, the central rib 1502 traverses the length of the plate assembly.

Figure 18:
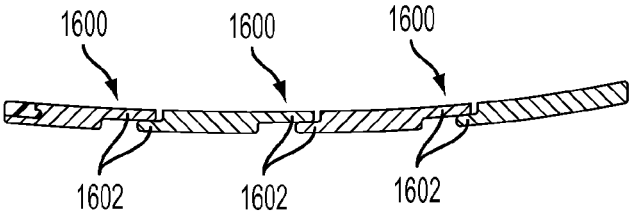

FIG. 18 shows another cross-sectional view of the assembled plates 206 shown in FIG. 15. Another portion of the overlapping regions 1600 of the extensions 1602 are shown.

Figure 19:
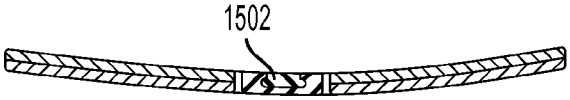
Figure 20:
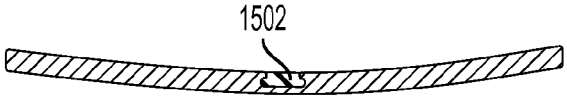

FIGS. 19 and 20 show additional cross-sectional views of the central rib 1502. As shown, the central rib 1502 has consistent lateral and vertical dimensions down a substantial portion of its length. However, in other examples other geometric characteristics are possible.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

The invention claimed is:

1. An articulating footwear sole, comprising:

a unitary midsole having a forefoot region and a heel region connected by a medial side and a lateral side, the midsole further having a recess, the recess positioned between the lateral and medial sides of the midsole, the midsole interposed between an outsole and an insole; and a first plate having a first end interlocking with a second end of a second plate, the first and second plates positioned within the recess and held in place free of adhesive.

2. The articulating footwear sole of claim 1, wherein the first and second ends partially overlap with one another across a full width of the first and second plates, and wherein the recess is wholly within the midsole.

3. The articulating footwear sole of claim 1, wherein the first and second plates are positioned in the forefoot region of the articulating footwear sole.

4. The articulating footwear sole of claim 1, wherein the first and second ends are moveable with respect to one another.

5. The articulating footwear sole of claim 1, wherein an overlapping region of the first and second plates is curved across a width of the articulating footwear sole.

6. The articulating footwear sole of claim 1, wherein the first and second ends include corresponding extensions configured to interlock with one another.

7. The articulating footwear sole of claim 6, wherein at least one of the extensions is curved in a cross-section perpendicular to a line tangent to the first and second ends.

8. The articulating footwear sole of claim 1, wherein the first and second ends extend in a direction from the medial side of the midsole to the lateral side of the midsole.

9. The articulating footwear sole of claim 1, wherein the insole has a partially clear region vertically above at least a portion of the first end and the second end.

10. An articulating footwear sole, comprising:

a unitary midsole having a forefoot region and a heel region connected by a medial side and a lateral side, the midsole further having a recess, the recess positioned between the lateral and medial sides of the midsole;

a first plate including a first end;

a second plate including a second end, the first end configured to moveably overlap with the second end, the first and second plates positioned in the recess and contained within the recess of the midsole;

an insole; and an outsole, separate from the midsole, the midsole interposed between the insole and the outsole.

11. The articulating footwear sole of claim 10, wherein the first and second plates are integrated into the midsole.

12. The articulating footwear sole of claim 10, further comprising a third plate having a first end articulably overlapping with a second end in a fourth plate.

13. An articulating footwear sole, comprising:

a unitary midsole having a forefoot region and a heel region connected by a medial side and a lateral side, the midsole further having a recess, the recess positioned between the lateral and medial sides of the midsole;

a first plate including a first end;

a second plate including a second end, the first end configured to moveably overlap with the second end, the first and second plates positioned in the recess; and a central rib that traverses a longitudinal length of the first and second plates and centrally connects the first and second plates.

14. The articulating footwear sole of claim 13, wherein the central rib extends along a combined length of the first and second plates.

15. The articulating footwear sole of claim 13, wherein the first and second plates are co-molded around the central rib.

16. The articulating footwear sole of claim 13, wherein the first and second plates are formed of a different material than the central rib.

17. The articulating footwear sole of claim 13, wherein the midsole further includes one or more protrusions extending into one or both of the first and second plates.

18. The articulating footwear sole of claim 13, further comprising:

a first attachment apparatus coupled to the first plate; and a second attachment apparatus coupled to the second plate, the first and second attachment apparatuses configured to attach to each other.

19. The articulating footwear sole of claim 13, the first plate further comprising a connection recess, the second plate further comprising a connection extension, the connection recess and connection extension extending longitudinally and configured to mate with each other.

* * * * *